US005623882A

United States Patent [19]

Price

[11] Patent Number: 5,623,882

[45] **Date of Patent: *Apr. 29, 1997**

[54] PLASTIC TABLE STRUCTURE

[75] Inventor: Mark E. Price, Fort Smith, Ark.

[73] Assignee: Alltrista Corporation, Muncie, Ind.

[ * ] Notice: The term of this patent shall not extend beyond the expiration date of Pat. No. 5,443,020.

[21] Appl. No.: 410,921

[22] Filed: Mar. 27, 1995

Related U.S. Application Data

[62] Division of Ser. No. 166,207, Dec. 13, 1993, Pat. No. 5,443,020.

[51] Int. Cl.[6] ..... A47B 3/00

[52] U.S. Cl. ..... 108/129; 108/161

[58] Field of Search ..... 108/129, 132, 108/901

[56] References Cited

U.S. PATENT DOCUMENTS

| | | | |
|---|---|---|---|
| 2,278,810 | 4/1942 | Virtue et al. . | |
| 2,689,158 | 9/1954 | Mahr . | |
| 2,921,825 | 1/1960 | Spiegel | 108/132 X |
| 3,213,570 | 10/1965 | Abramson . | |
| 3,319,958 | 5/1967 | Bender . | |
| 3,349,728 | 10/1967 | Barecki et al. . | |
| 3,368,504 | 2/1968 | Cohen . | |
| 3,416,468 | 12/1968 | Peterson et al. . | |
| 3,628,470 | 12/1971 | DeLuca . | |
| 4,383,488 | 5/1983 | Macho et al. | 108/129 |
| 4,399,975 | 8/1983 | Trimarco et al. | 108/901 X |
| 4,444,124 | 4/1984 | Burr . | |
| 4,507,348 | 3/1985 | Nagata et al. . | |
| 4,822,661 | 4/1989 | Battaglia . | |
| 4,951,576 | 8/1990 | Cobos et al. . | |
| 5,284,100 | 2/1994 | Thorn | 108/129 |
| 5,357,872 | 10/1994 | Wilmore | 108/132 X |

*Primary Examiner*—Jose V. Chen
*Attorney, Agent, or Firm*—Brinks Hofer Gilson & Lione

[57] ABSTRACT

A plastic table structure includes a top having a planar upper surface portion, a lower plastic portion and a central wooden frame interposed between and enclosed by the top and lower portions. A pair of folding leg assemblies for supporting the table are rotatably carried by the lower plastic portion and pivotable between an open, top-supporting position and a retracted, enclosed position in leg-receiving channels formed in the underside of the lower plastic portions. Each leg assembly includes a pair of upper transverse supports that engage the leg-receiving channels of the lower plastic portion and extend across its entire width to provide a plurality of transverse load-bearing interfaces to enhance the rigidity and load-bearing capability of the plastic table.

17 Claims, 6 Drawing Sheets

PLASTIC TABLE STRUCTURE

This application is a division, of application Ser. No. 08/166,207 filed Dec. 13, 1993 now U.S. Pat. No. 5,443,020.

FIELD OF THE INVENTION

The present invention relates generally to table structures and, more particularly, to a large, lightweight plastic table structure with folding legs and improved load bearing and leg attachment characteristics.

BACKGROUND OF THE INVENTION

Numerous types of folding tables structures are known in the prior art, including portable tables having folding legs that include locking means for holding the legs in an operative position. Such tables are commonly used by many groups, including assembly and convention halls, hotels, institutions, churches, meeting establishments and the like, that cater to large groups of people. Large portable folding tables, often referred to as "banquet tables", allow the organizations or institutions to tailor the configurations of banquet rooms to the anticipated requirements of the group. In the event that folding tables are not needed for a particular function or event, they can, of course, be stored. Thus, use of folding tables permits such organizations to maximize the effectiveness and utilization of their available floor space and accompanying facilities, while minimizing the storage space requirements for the tables when they are not needed.

Common problems encountered with some prior art tables are that they are fabricated of heavy materials, often requiring two or more persons to handle the tables. Such tables are typically made of fiber or particle board, plywood, or Masonite-type materials, and may also have a Formica type surface laminated onto one of the foregoing underlying materials. Such tables have frequently been made stronger or sturdier by making the table tops thicker and heavier. Attempts to make the table tops thicker and sturdier only exacerbates the bulkiness and weight problem. Such prior art tables may weigh, for example, eighty to ninety pounds or more for a banquet-sized table.

Another drawback with prior art tables such as those discussed above is that the means of attachment of the legs to the table tops often tend to fail or give way prematurely, sometimes pulling completely away from the table top, either ruining it altogether, or necessitating repairs. The repairs often require that additional leg fastening means, such as bolts or the like, extend to the table top, which can be unsightly.

Another problem with such prior art folding tables is that the materials used in the tables are susceptible to water damage. Materials which absorb water, or other liquids coming into contact with them prematurely deteriorate and provide an unsightly appearance. Still another problem with such prior art tables is that they can sometimes splinter if subjected to improper loads, or even after periods of routine use. Such splintering is at least annoying and can be hazardous.

One proposed solution to the prior art problems discussed above is to make parts of the table tops. from lightweight metals, such as aluminum. Aluminum tables can be expensive for most organizations and tend to dent easily when subjected to the routine wear and tear and to be noisy in normal use. Such tables can also have sharp edges, posing a hazard, like the splinters of the prior art tables discussed above.

Another proposed solution is the use of plastic materials for such tables. U.S. Pat. No. 3,628,470 to De Luca discloses a portable lightweight foldable support platform comprising a planar support member fabricated of a core of lightweight, high-strength material, such as a balsa wood composition, and having a plastic layer secured to the underside of the core and a nonskid textured plastic layer secured to the upper surface of the core. The longitudinal sides of the core have aluminum rails secured thereto, and the leg assemblies are provided with pivotable hinges to enable them to be folded flat against the underside of the platform for storage.

U.S. Pat. No. 4,951,576, to Cobos et al., discloses a portable plastic folding table. The table structure includes upper and lower plastic table top halves with reinforcing a framework grid sandwiched therebetween. The framework grid is preferably made of wood, and includes joists or beam members interconnected by reinforcing cross members. The framework grid is received in a correlatively-shaped shell integrally formed in the lower plastic half of the table top. Folding legs are mounted on the underside of the table top by using fasteners that pass through the lower plastic half of the table top and a pair of cross members of the framework. The lower table top half is provided with gussets at selected locations between relatively high vertical walls and the adjacent horizontal planar surfaces. Stiffening ribs, which may be extensions of the shell, are also disposed on the lower table top half.

U.S. Pat. No. 4,951,576 further discloses that the reinforcing cross members and joists of their wooden framework are disposed at locations to provide structural support and rigidity to the plastic-sandwiched table top structure, and to provide attachment and positive mechanical support for the folding legs of the table. In assembly, bolts or other fastening means are inserted through the cross members and through the lower plastic half of the table top to permit attachment of support brackets for the legs, prior to affixing the upper plastic half of the table top to the lower plastic half. Support brackets for securing the folding legs to the table are affixed to the bolts or fasteners that extend through lower plastic half of the table top. In the table of the '576 patent, loads imposed on the ends of the table are carried by the plastic lower half of the table and the only stress relief for the ends of the plastic lower half is at the side rails of the framework. Therefore, gusset means are provided in the underside corners of the lower plastic half to maintain its structural integrity. Moreover, the folding leg assemblies must be attached (bolted) to the cross members of the wooden framework to carry the forces imposed by table top loads through the wooden cross members for transfer to the folding legs and to prevent the imposition of possibly destructive stress concentrations on the lower plastic table half by the leg attachment brackets.

Notwithstanding these developments, a need exists for a portable, lightweight yet strong, foldable table structure with improved load bearing characteristics, folding legs and means for readily securing the folding legs to the underside of the table structure.

SUMMARY OF THE INVENTION

This invention provides a portable, lightweight and strong table top. The table top of the invention is reinforced by a separate reinforcing core, and by one or more folding leg assemblies. The table top comprises a top portion that forms a planar upper surface, a lower plastic portion that engages the top portion, in part, and forms a plurality of downwardly extending recessed portions with the reinforcing core therebetween. One or more folding leg assemblies are received in, and rotatably carried by, receiving surfaces formed by the plurality of downwardly recessed portions in the lower plastic portion of the table top. Preferably, the one or more leg assemblies include elongated table top supporting members that are received and retained by, and engage and support, the lower plastic table portion transversely of the table top in positions to supplement the reinforcing core, thus increasing the table strength, reducing its weight, and permitting better utilization of the reinforcing effect of the core.

The table structure of the invention comprises, in one embodiment, an upper plastic portion comprising a planar upper surface, a lower plastic portion, a central reinforcing core interposed between, and enclosed by, the upper and lower portions, external leg support means affixed to the lower portion for supporting the table above a floor surface, and means formed in the lower table portion for receiving and securing the external leg support means to the table structure. The upper and lower plastic portions of the table structure are of substantially the same peripheral size and shape and are disposed in a close-fitting relation. Bracket means can be disposed and enclosed between the upper and lower table portions for securing the reinforcing core and the lower table portion.

The lower portion includes a network of downwardly extending recesses integrally formed in relief fashion therein for receiving and partially enclosing the central reinforcing core, including a plurality of strengthening ribs integrally formed therein for providing stability and localized rigidity to the table structure. The lower portion of the table structure preferably includes at least two relatively deep longitudinal recesses formed in relief fashion in the lower portion adjacent each opposing longitudinal edge thereof, and preferably at least one relatively shallow transverse recess formed in relief fashion in the lower portion.

The central core interposed between and enclosed by the upper and lower portions preferably comprises at least two beam members extending longitudinally of the structure in parallel fashion, first and second end pieces extending transversely between the beam members proximal to the opposite ends thereof, and at least one cross member extending transversely between and affixed to the beam members and arranged centrally between the first and second end pieces along the longitudinal axis of the table structure. The two beam members and the first and second end pieces can form a rectangle when assembled, and the first and second end pieces can extend into stiffening ribs disposed at the ends of the lower plastic table portion. The first and second end pieces can have rounded corners to match the lower table portion and are preferably let into notches of the beam members. In longer tables of the invention (e.g., about eight feet long) a pair of cross members can extend transversely between the beam members at positions spaced equally from the center of the table. In shorter tables of the invention (e.g., about six feet long), the central core includes a single cross member between the beam members generally at the center of the table.

The external support means of this invention comprises leg assemblies longitudinally spaced and positioned adjacent opposite ends of the lower portion. Each leg assembly can include transversely extending support members to interface the recesses formed in the lower table portion for retention therein to secure the leg assembly to the table and to support the lower table portion across its entire width. The means formed in the underside of the lower plastic portion for receiving and securing the external support means comprises a plurality of portions adapted to receive the leg assemblies, preferably by the network of recesses forming leg-receiving channels or saddles. The leg assemblies are pivotally secured within the leg-receiving channels or saddles by retaining brackets and fasteners. Preferably, transversely extending leg members are rotatably received in the network of recesses, allowing the leg assembly to be folded between and open and retracted closed positions.

As set forth below, the invention further provides a novel concealed means for assembly and rotatably fastening together the lower plastic table portion, reinforcing core and folding leg assembly.

Other features and advantages of the invention will be apparent from the drawings and more detailed description that follows.

BRIEF DESCRIPTION OF THE DRAWINGS

FIG. 3A is a top plan view of the lower portion of a longer version of a preferred embodiment of the table of this invention with the upper portion removed for illustration and FIGS. 3B–3F are various section views taken from. FIG. 3A where indicated;

DETAILED DESCRIPTION OF THE BEST MODE

Figure 1:
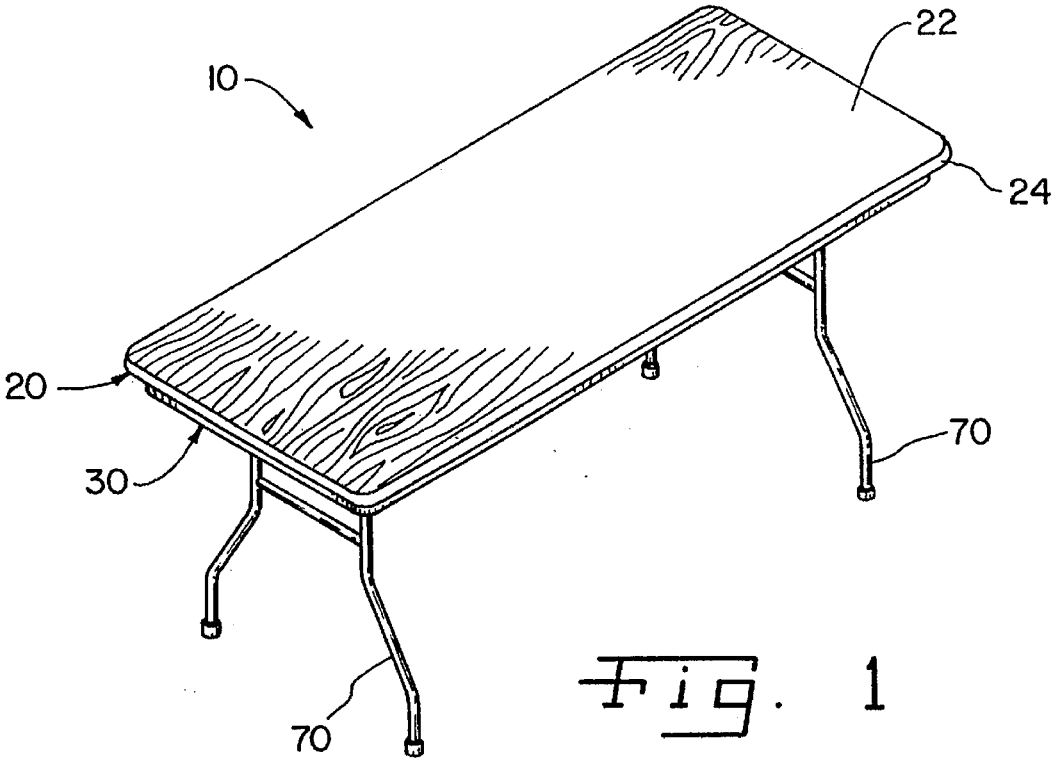
FIG. 1 is a perspective view of a preferred embodiment of the table structure of this invention.

As shown in FIGS. 1–4 and 7, this invention provides a table top 20, preferably plastic, that is reinforced by a separate reinforcing core 50 (FIGS. 4A and 4B) and one or more folding leg assemblies 70. The table top 20 comprises a top portion 22 forming a planar upper surface, a lower plastic portion 30 forming a plurality of downwardly extending, recessed portions 34, 36, 37, 38 and an upper portion, 39' engaging the top portion, and a reinforcing core 50 therebetween one or more external support means, such as folding leg assemblies 70, are received in and rotatably carried by leg-receiving surfaces, such as channels 90, 94 and saddles 92, formed by the plurality of downwardly recessed portions of the lower plastic portion 30 of the table top. Preferably, the one or more leg assemblies 70 include elongated table top supporting members 76, 78 that are received and retained by leg-receiving portions 90, 92, 94 of the lower plastic table top portion 30 transversely of the table top and engage and support the table top at locations that supplement the reinforcing core 50, thus increasing the table strength, reducing its weight, and permitting better utilization of the reinforcing effect of the core.

Figure 5:
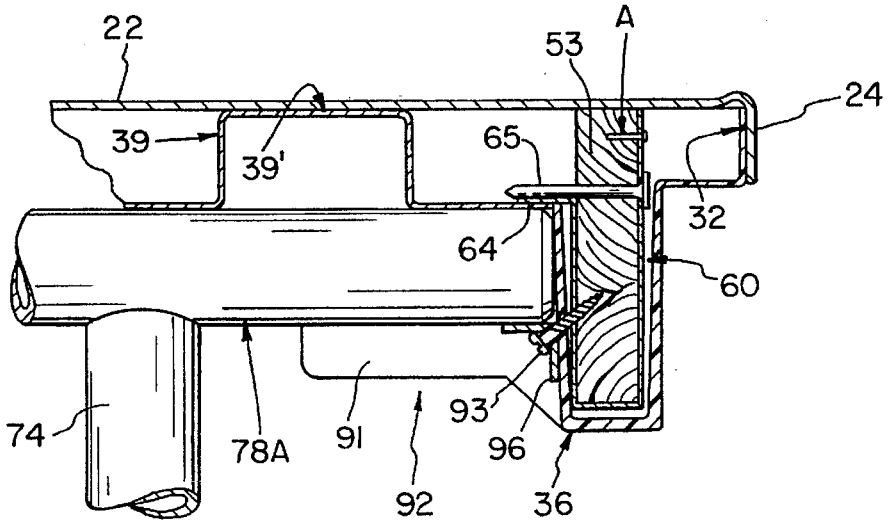
FIG. 5 is an enlarged partial cross sectional view of the means of this invention for assembling and rotatably fastening together the lower plastic portion of the tables, the reinforcing core and the leg assemblies thereof.

As more fully explained below, the leg-receiving channels or saddles 90, 92, 94 can form bearings for rotatably engaging portions of the folding leg assemblies 70. For example, tubular member 78 of folding leg assembly 70, shown in FIGS. 7A and 7B, can be rotatably carried by the leg-receiving saddles 92 formed in the lower plastic table portion 30 and retained therein by brackets 96 that span the saddles 92, as shown by FIG. 5.

Figure 2:
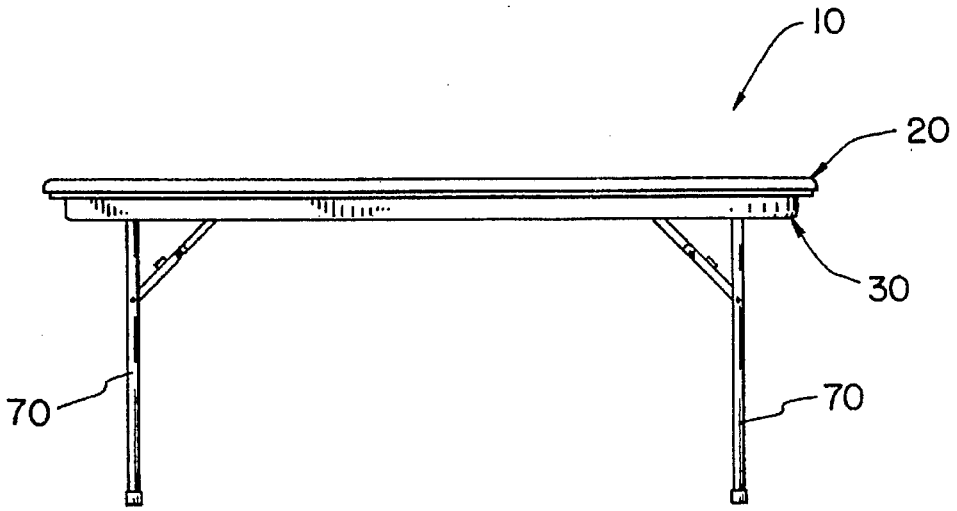
FIG. 2 is a side elevational view of the table of FIG. 1.
Figure 6A:
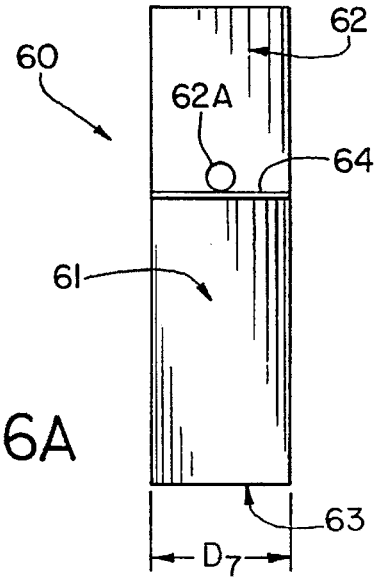
FIG. 6A is a front plan view of the bracket of FIG. 5 incorporated in the tables of this invention.
Figure 6B:
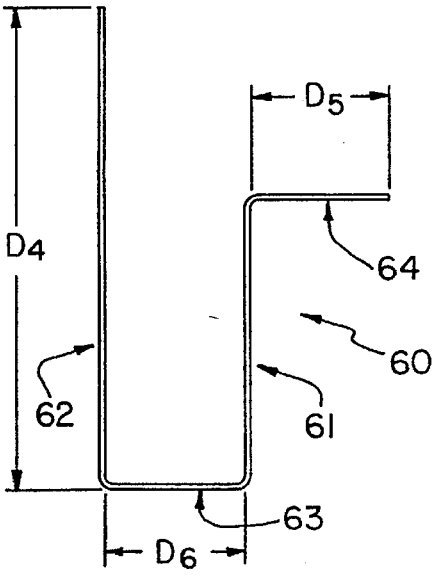
FIG. 6B is a side plan view thereof.
Figure 10A:
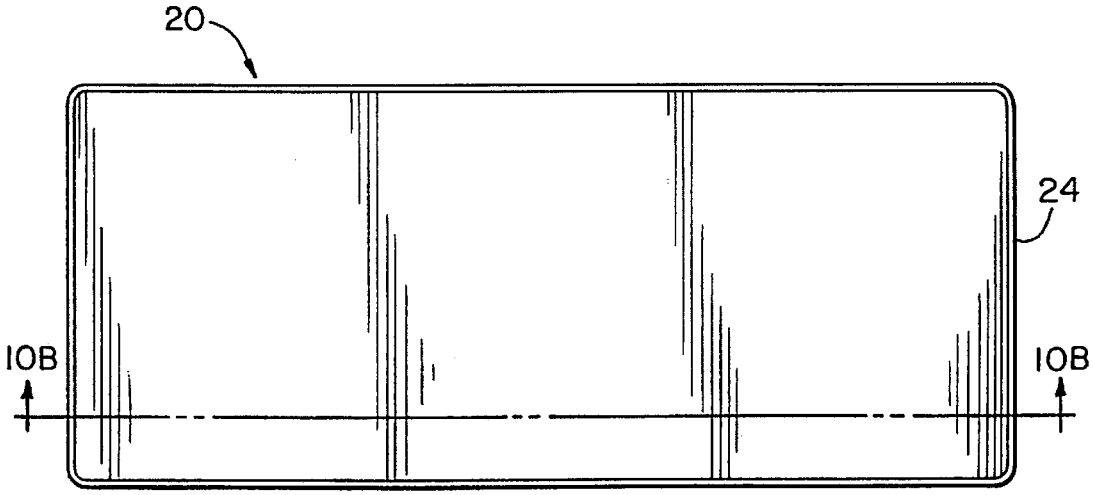
FIG. 10A is a bottom plan view of the upper portion of a preferred embodiment of the invention and FIG. 10B is a section view taken along line 10B—10B of FIG. 10A.
Figure 10B:
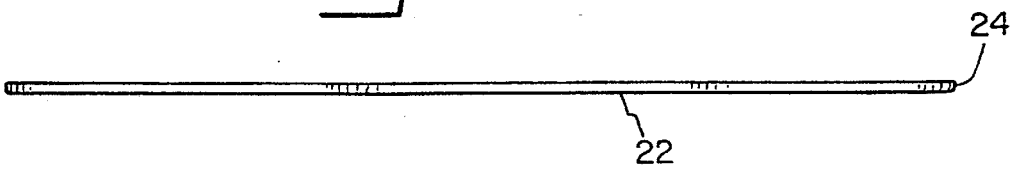

The embodiment of the table structure 10 of the invention shown generally in FIGS. 1, 2 and 10 comprises a table top 20 including an upper portion comprising a planar upper surface 22 and a downwardly extending peripheral flange 24, a lower plastic portion 30 having an upwardly extending peripheral flange (referenced 32 in FIG. 3) in register with the upper planar surface 22 of upper portion 20, a central core (referenced 50 in FIG. 4) interposed between and enclosed by the upper and lower portions 20 and 30, external support means 70 affixed to the lower portion for supporting the table above a floor surface, means (referenced 90 in FIGS. 3 and 5) formed in lower table portion 30 for receiving and securing the external support means 70 to the table structure 10 and bracket means (referenced 60 in FIGS. 4–6) disposed and enclosed between the upper and lower portions for securing together the external support means 70, the lower portion 30, and the core 50. The upper and lower portions 20 and 30 of table structure 10, which are both preferably formed from plastic, are of substantially the same peripheral size and shape and are disposed in a close-fitting relation with the upwardly extending flange 32 of lower portion 30 being received within the downwardly extending skirt 24 of upper portion 20.

Figure 3A:
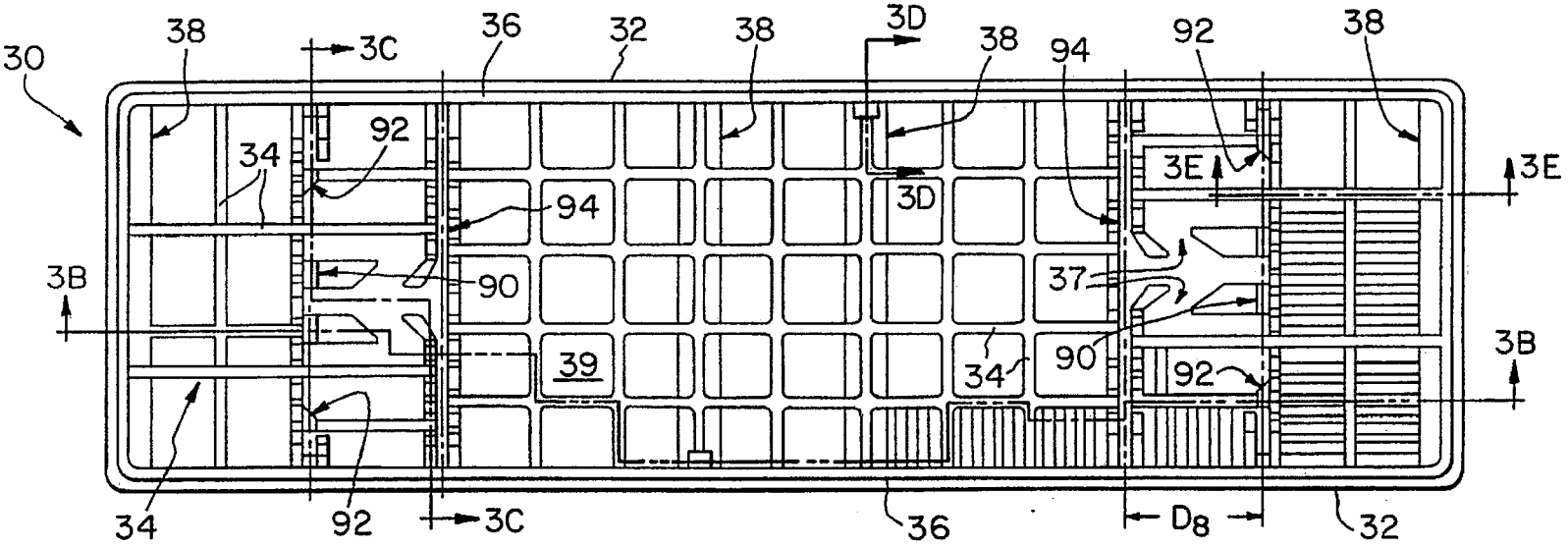
Figure 3B:
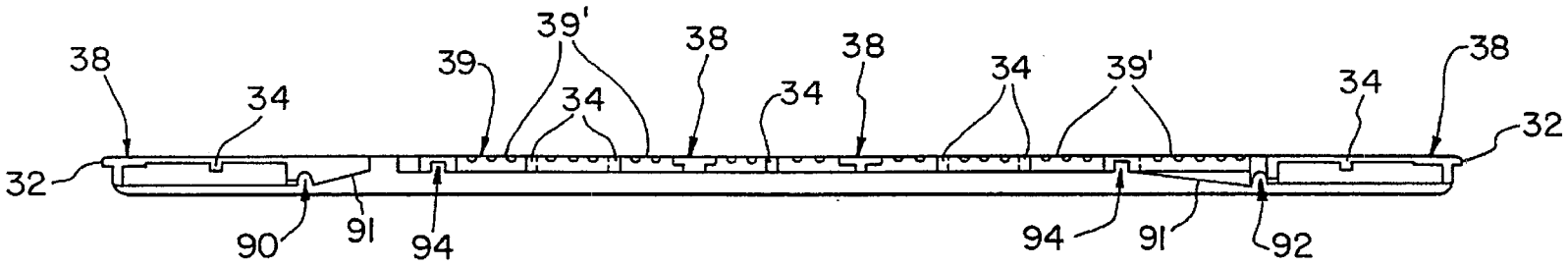
Figure 3C:
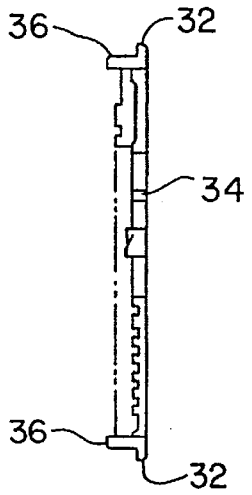
Figure 3D:
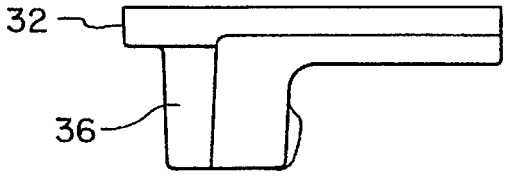
Figure 3E:
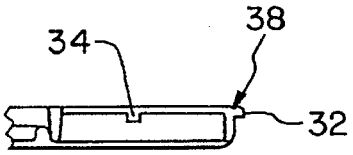
Figure 3F:
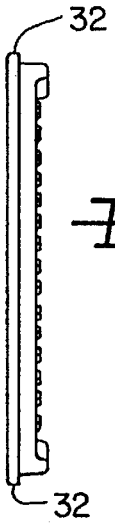

Referring to FIGS. 3A–3F, lower portion 30 is shown from above with upper portion 20 removed for clarity. FIGS. 3B–3E are section views taken along reference lines 3B—3B, 3C—3C, 3D—3D and 3E—3E respectively, of FIG. 3A. FIG. 3F is an end plan view of the lower portion 30 of FIG. 3A. Lower portion 30 includes a network of recesses integrally formed in relief fashion, extending downwardly therein, for receiving and partially enclosing the central core 50, for providing a plurality of strengthening ribs for adding rigidity to table structure 10, and for locating and rotatably engaging and retaining folding leg assemblies 70 for supporting the table top 20. The plurality of strengthening ribs 34 formed in lower portion 30 includes at least one, preferably two, relatively deep stiffening ribs or recesses 36 integrally formed in relief fashion therein and at least one torsional resistant or recess rib 37 also integrally formed in relief fashion. Further included is at least one, and preferably four, relatively shallow, latitudinally extending stiffening ribs or recesses 38 extending between the pair of deep stiffening ribs 36. The network of recesses, including strengthening ribs 34, deep ribs 36 and shallow ribs 38, contribute localized rigidity to table top 20. The lower plastic table portion 30 further forms a first surface portion for engaging the underside of the top portion 22 forming the planar top surface, which includes a plurality of supporting elements 39 spaced throughout the lower plastic portion 30 with bearing surfaces 39' for supporting and bonding to the top portion 22 of the table top 20 (see FIG. 5).

Figure 4A:
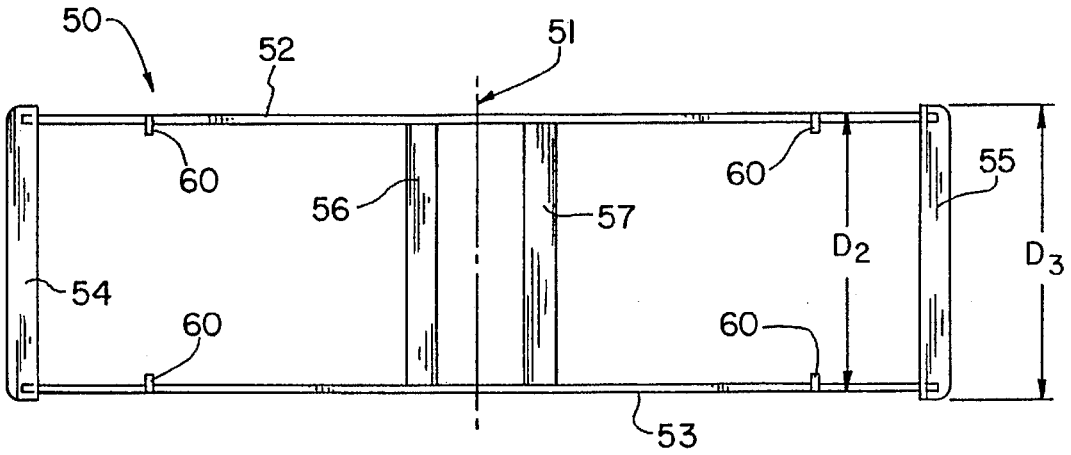
FIG. 4A is a top plan view of the central core framework of the table of FIG. 3.
Figure 4B:
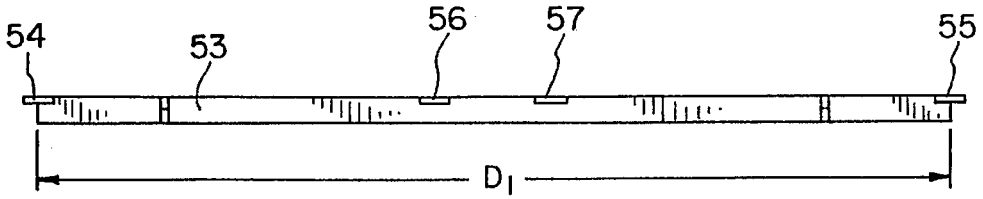
FIG. 4B is a side plan view thereof.

Referring now to FIGS. 4A and 4B, the central reinforcing core 50 interposed between and enclosed by the upper and lower portions 20 and 30 can comprise at least two beam members 52 and 53 extending longitudinally of the structure 10 in parallel fashion, first and second end pieces 54 and 55 extending transversely between the beam members 52 and 53 proximal to the opposite ends thereof, and, in the longer version of the table, a pair of central cross members 56 and 57 extending transversely between and affixed to the beam members and arranged between end pieces 54 and 55. End pieces 54 and 55 extend into stiffening ribs 38 disposed at the ends of the lower plastic portion 30. As shown in FIG. 4A, beam members 52 and 53 and the end pieces 54 and 55 form a rectangle when assembled with their respective ends disposed in an end-to-end relation. End pieces 54 and 55 have external corners radiused to match the plastic portion of 30 thereby providing a close fit in stiffening rib 38. End pieces 54 and 55 are let into beam members 52 and 53 to provide a planar upper surface for engagement with the lower surface of top portion 22. As shown in FIG. 4B, beam members 52 and 53 are disposed with their deepest dimension vertical while end pieces 54 and 55 and cross members 56 and 57 are disposed with their longest dimension horizontal. The end pieces and cross members are attached at their respective ends to beam members 52 and 53 so that the upper flat faces thereof are substantially flush with the upper side edges of the beam members and with bearing surfaces 39' of the supporting elements 39 of the first surface portion of lower plastic portion 30.

As indicated above, in the longer version of the preferred embodiment of the invention, the central core 50 includes the pair of cross members 56 and 57 extending transversely between beam members 52 and 53, as shown in FIGS. 4A and 4B, equi-distantly on opposite sides of central latitudinal axis 51 of the core 50. For any table length or width, the core 50 preferably has a length dimension $D_1$ from the outside ends of the side beams of approximately 3 inches less than table length, a first width dimension $D_2$ measured from the outside edges of beams 52 and 53 of approximately 2 inches less than table width, and a second width dimension $D_3$ measured from the outside ends of end pieces 54 and 55 of approximately 4¼ inches less than width of table.

The central core of the preferred embodiments of this invention can be constructed from wood, wood products, steel or other metal tubing, or plastic.

Referring again to FIG. 3, lower portion 30 of table structure 10 preferably includes at least two relatively deep stiffening ribs 36 defining longitudinal recesses extending downwardly in relief fashion in the lower portion 30 adjacent the opposing longitudinal edges thereof for receiving and partially enclosing the two beam members 52 and 53. The shallow transverse recesses 38 that are formed in relief fashion adjacent the opposite ends of lower portion 30 receive and partially enclose each of the first and second end pieces 54 and 55. Further, a pair of shallow transverse recesses 38 are also disposed near the central region of lower portion 30 for receiving and partially enclosing transverse cross members 56 and 57.

The bracket means 60 of the structure 10 shown in FIGS. 4–6 and 9 provide a novel and concealed means for transferring loads imposed on core 50 to leg assemblies 70 in saddles 92. Bracket means 60 comprises one or more load bearing metal hangers, each having an inner leg 61, an outer leg 62 and a transverse portion 63 connecting the inner leg and the outer leg at their lower ends so that the legs 61 and 62 are disposed in a parallel fashion to define a U-shaped cross section. The inner leg 61 is preferably shorter than the outer leg and has a shoulder portion 64 extending outwardly therefrom in a direction opposite to that of outer leg 62. Outer leg 62 has a height dimension $D_4$ of about 2.5 inches, shoulder 64 has a length dimension $D_5$ of about 0.75 inch, lower transverse portion 63 has a depth $D_6$ of about 0.75 inch, and hanger 60 has an overall width $D_7$ of about 0.75 inch. The outer leg 62 has a hole 62A formed therein to accept a pin 65, which can be a nail, and locate the pin 65 to support the shoulder portion 64, as shown in FIG. 5.

In use, as shown in FIG. 5, the bracket means, or hangers 60 are disposed in an upwardly facing fashion within the deep recesses 36 of lower portion 30, with the outer leg 62 disposed adjacent the periphery of lower plastic portion 30 and with the shoulder portion 64 of inner leg 61 and pin 65 in an overlapping engagement with the lower plastic portion 30, preferably over tubular member 78 and legs 74 of the folding leg assembly 70 to transfer table top loads directly to the legs.

Bracket means 60 are attached to the reinforcing core 50, as shown in FIGS. 4A and 4B, before the table top is assembled. Each beam member 52 and 53 is received between the inner and outer legs 61 and 62 of the hanger 60 with the lower longitudinal edge of the beam member abutting the transverse portion, 63 of the hanger 60. As shown in FIG. 5, the brackets 60 are then secured to the beam members by first fasteners "A" defined by lanced clips and/or pins or nails or other suitable fasteners through their outer legs 62. The supporting pins 65 are then inserted through holes drilled in the beam members 52 and 53. Use of the bracket means 60 for assembling and rotatably fastening together the lower plastic table portion 30, reinforcing core 50 and leg assemblies 70 is described below.

The external support means of this invention preferably comprise leg assemblies 70, as shown in FIGS. 1 and 2, longitudinally spaced and positioned adjacent opposite ends of the lower plastic portion 30. In the leg assemblies of FIGS. 7A and 7B, each leg assembly 70 includes a first upper transversely extending cross support 78 to rotatably interface with the leg-carrying recesses 90 (discussed further below) formed in the lower table portion 30 for retention therein to secure the leg assembly 70 to table 10 and to support the lower table portion 30 across its entire width. Ends 78A of cross support 78 are rotatably received and retained in saddles 92 adjacent each side of recesses 90, allowing the leg assembly 70 to be folded between open and closed positions. Leg assemblies 70 can further include a lower cross member 72 secured to and extending between opposing legs 73 and 74.

Folding support or brace 75 provides a second cross support 76 which is received in leg-receiving channels 94 of lower portion 30 (FIG. 3A). As shown in FIG. 2, the second cross support 76 of the folding leg assembly engages the leg-receiving channel 94 formed in the lower plastic portion 30 at a location spaced from the first cross support 78 of the folding leg assembly.

In the preferred embodiment shown in FIG. 3 both the first and second cross supports 78 and 76 of the folding leg assembly 70 engage the lower plastic table portion 30 in leg-receiving channels 90 and 94, respectively, across the portion extending between deep ribs 36 and structurally support the table top at these spaced locations, which lie between the end pieces 54, 55 and the cross members 56, 57 of reinforcing core 50, thus permitting increased loads to be applied, to the table top without exceeding the stresses at which the table top may break or buckle. The folding leg assemblies thus lend increased uniformity in supporting table top loads, reduce the weight that might otherwise be required in the reinforcing core and permit, for a given weight, the location of the cross members of the reinforcing core to areas of the table, such as its cantilevered ends, where increased support is needed to protect the plastic table portions. The cantilevered ends of the table top are not only sensitive to top loading but to loads and impacts acting on the edges of the table top 20 at angles other then normal to the top. The end pieces 54, 55 and their close engagement and reinforcement of the top portion 20 protect the table top portion 20 when it is stood on end or accidently dropped.

Figure 7A:
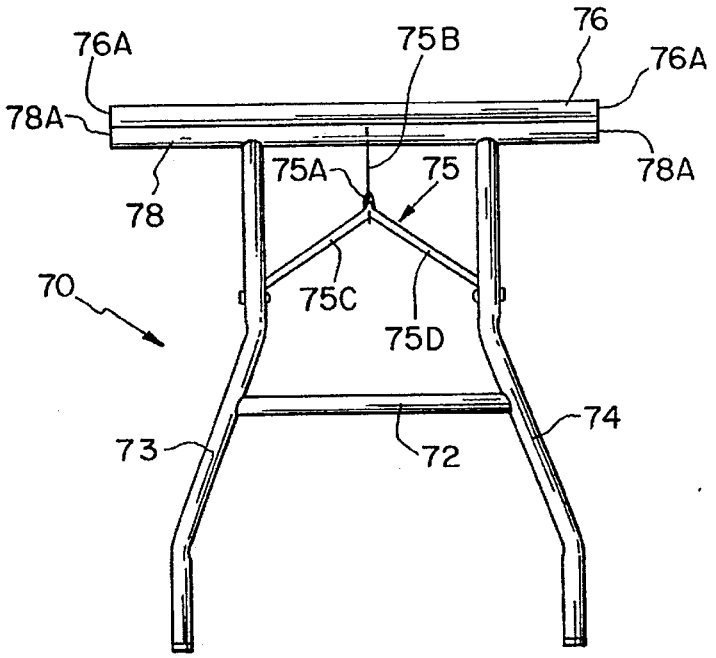
FIG. 7A is a front plan view of a folding leg assembly incorporated in the tables of this invention.
Figure 7B:
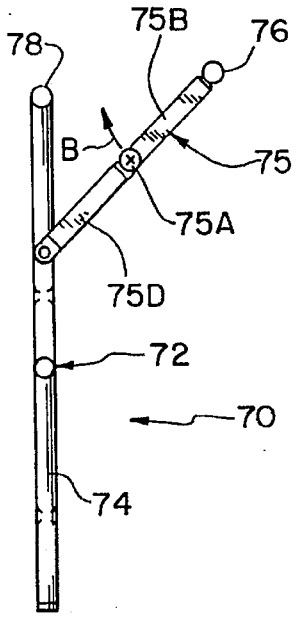
FIG. 7B is a side view thereof.

As shown in FIG. 7B, first cross support 78 is disposed slightly lower than second transverse cross support 76. In engagement with the lower plastic portion 30, the second transverse cross support 76 engages the lower plastic portion 30 in channels 94, which, as shown in FIG. 3B, are higher than channels 92 in which the first cross support 78 is received, permitting the leg assemblies 70 to fold into a position that is retracted within the network of recesses. This retracted position of the folded leg assemblies 70 permits close stacking of the tables 10.

Folding brace 75 can include a hinge device 75A so that leg assembly 70 can be moved between an extended operative position shown in FIGS. 2 and 7 and a retracted storage position with the leg assemblies 20 folded flat against the lower plastic portion 30 within its leg-receiving recesses. Folding brace 75 is preferably provided with an inverted Y-shape with a single upper extension 75B extending between the second cross support 76 and the hinge device 75A, and two lower extensions 75C and 75D extending from the hinge device 75A downwardly and outwardly to each of the opposing legs 73 and 74, respectively, of leg assembly 70. Hinge 75 can further include a locking pawl of the conventional type permitting the rotation of the folding brace 75, and accordingly the leg assembly 70, only in an inward direction shown by reference arrow "B" toward the underside of the lower table portion 30. The second cross support element 76 may, if desired, be rotatably retained in leg-receiving channel 94.

Referring to FIGS. 3 and 5, the means formed in the underside of lower portion 30 for receiving and securing the external support means (leg assemblies 70) to structure 10 includes recessed leg-receiving channels 90 and 94 integrally formed in the underside of plastic lower plastic portion 30, including ramps 91 and saddles 92 formed in the lower portion 30 adjacent the long sides thereof. Saddles 92 are formed in the underside of the lower portion 30 adjacent the deep ribs 36 at the sides of the table and have open tops and semi-circular bottoms to house and rotatably carry the ends 78A of the first tubular cross support 78 of folding leg assembly 70.

During assembly of table structure 10, the bracket means or hangers 60 and supporting pins 65 are applied to the long side beams 52 and 53 of core 50, preferably about 10–12 inches from end cross pieces 54 and 55, at the location of each of saddles 92 formed at the outermost ends of the leg-receiving channels 90 in the underside of lower plastic portion 30. After the lower plastic portion 30 and central core 50 are assembled, the first cross support 78 of one leg assembly 70 is positioned within the leg-receiving channels 90 with its ends 78A nested in saddles 92 adjacent the long edges of lower plastic portion 30, and the second cross support 76 is positioned within an additional leg-carrying channel 94 disposed inwardly from the first channels 90. Folding leg assemblies 70 are then rotatably secured at ends 78A in the saddles 92 by angle brackets 96 which span the saddles 92 and are secured in position by fasteners 93 (see FIG. 5). The fasteners 93, typically anchor screws or the like, adjacent to angle brackets 96 extend through the inner wall 36' of the deep recess 36 of lower plastic portion 30, the hanger 60 disposed within the deep recess 36, and into the beam member 53 received within the hanger 60. As shown in FIG. 5, the bracket means 60 are concealed within the upper and lower table portions 22 and 30.

Second cross support tubes 76 of leg assemblies 70 are similarly housed and retained in the transverse channels 94 that are formed in the underside of lower plastic portion 30 and extend across the entire width of lower portion 30 at locations remote from the cross members 56 and 57 of wooden core 50. Channels 94 for receiving second cross support 76 are preferably located a distance $D_8$ of about 9.63 inches from channels 92 (FIG. 3A). If desired, the ends 76A of transverse supports 78 can be rotatably retained within channels 94 adjacent the long sides of lower portion 30 with angle bracket 96 and anchor means 93 in the same manner as depicted in FIG. 5, excluding bracket 60.

Thus, when the table structure 10 is set up in an operative position such as that shown in FIGS. 1 and 2, leg assemblies 70 provide transverse load bearing interfaces for table 10 at four additional locations, e.g., the pair of first transverse cross supports 78 and the pair of second transverse supports 76, spaced intermediate of the wooden cross members 54–57 of central core 50 to enhance the strength of table 10 and eliminate the need for additional wooden cross support members. Accordingly, the co-action of leg-carrying channels 90 and 94 and tubular transverse leg assembly supports 76 and 78 not only secures the folding leg assemblies 70 to the table, but further acts to strengthen the plastic table by providing a plurality of transverse load-bearing reinforcing interfaces and increased table torsional stiffness.

Figure 8:
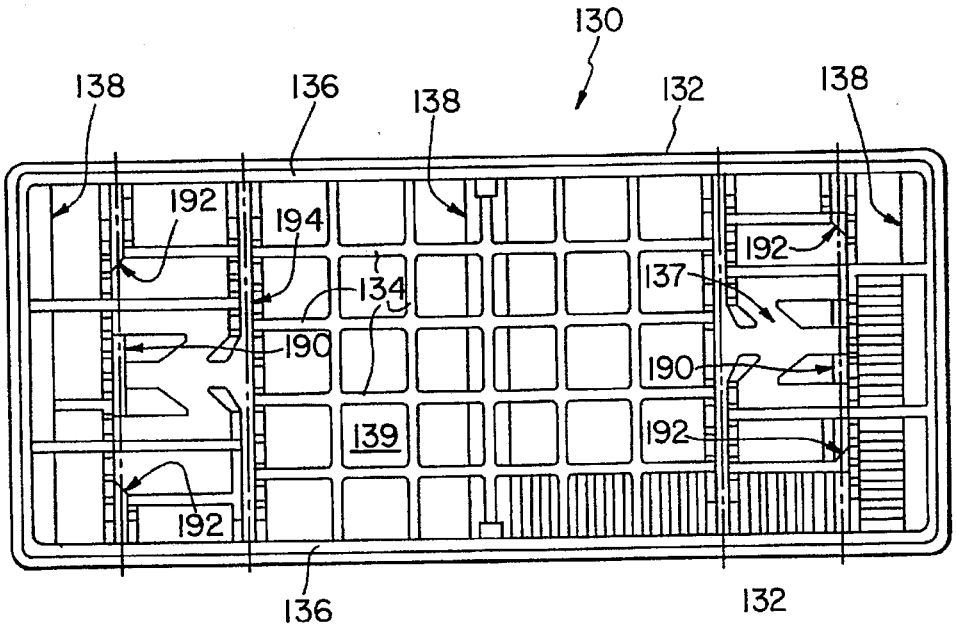
FIG. 8 is a top plan view of a the lower portion of a shorter version of a preferred embodiment of the table of this invention with the upper portion removed for illustration.
Figure 9A:
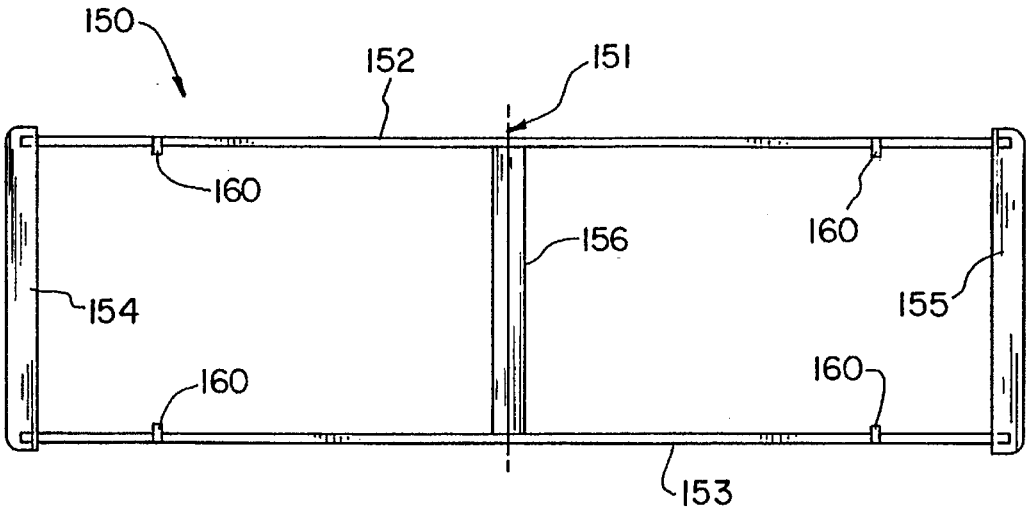
FIG. 9A is a top plan view of the central core framework of a shorter table of FIG. 8.
Figure 9B:
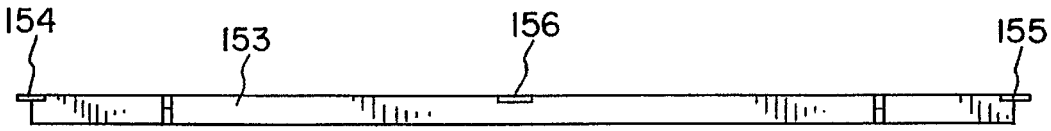
FIG. 9B is a side plan view thereof.

In the shorter version of the preferred embodiment of the table as shown and described below in relation to FIGS. 8 and 9, a central wooden core 150 includes a single cross member 156 extending transversely between longitudinal beam members 152 and 153. Core 150 is substantially similar to its longer relative shown in FIG. 4. The only difference being that core 150 of FIG. 9 includes only a single cross member 156 extending transversely between and affixed to side beams 152 and 153. Accordingly, the elements of core 150 shown in FIG. 9 are numbered similarly to their corresponding elements in FIG. 4. Similarly, the lower portion 130 for the shorter table shown in FIG. 9 is substantially similar to its longer relative shown in FIG. 3, the only significant difference being that lower portion 130 of FIG. 8 includes only a single transverse shallow recess 138 arranged along the latitudinal axis of portion 130 for receiving and partially enclosing single cross member 156 of FIG. 9. Accordingly, the elements of lower portion 130 shown in FIG. 8 are numbered similarly to their corresponding elements in FIG. 3, and the detailed discussion in relation to lower portion 30 and FIG. 3 applies equally as well to lower portion 130 and FIG. 8. This alternative embodiment can have a shorter overall length dimension of approximately 60 inches to 84 inches to define a 5' to 7' table, respectively with its width dimensions ranging from 18 to 36 inches, the same of the 8' version shown in FIGS. 3 and 4.

The upper and lower portions of table 10 can be inexpensively formed from a durable, relatively strong, substantially water-, or other liquid-, impervious, and relatively lightweight plastic. Thermoplastics such as acrylonitrile butadiene styrene ("abs"), polyethylene, polypropylene, high impact polystyrene, polyvinylchloride or the like, can be used. Thermosetting plastic materials may also prove suitable. Upper and lower table portions 22 and 30 can be constructed by utilizing any suitable conventional plastic manufacturing process, such as blow molding, injection molding, or vacuum molding. In some tables of the invention, the upper portion 22 of the table may be a material other than plastic.

The table top halves may be bonded together with any suitable adhesive or by any suitable process so long as a strong, permanent, and preferably waterproof, bond is achieved between the portions 22 and 30. Suitable adhesives include methacrylic, thermoset urethane or a solvent-type cement.

As noted above, unlike the prior art tables, tables of this invention have quite different load bearing characteristics and utilize the coaction of a reinforcing core and the pairs of transverse leg assembly supports to distribute load support over a long table top, to remove undue stress from the ends and central portions of the table top and to reduce the need for cross members in the reinforcing core. The invention also provides novel and convenient installation and attachment of the table legs to the lower table portion, and eliminates the need for any cement or adhesive between the central framework and the table top and the problem of a framework grid which may float between the table top halves. In the table of this invention, there is no need to allow for a thermal expansion or contraction of the table top halves with respect to the central wooden core 50 to avoid damage to the table top. Finally, this table 10 further eliminates the need for the separate leg supporting brackets that can provide stress concentration in the plastic table portion and require mounting to the reinforcing core.

While the device and method described above constitutes a presently preferred embodiment, the invention can take many other forms. Accordingly, it should be understood that the invention is to be limited only insofar as is required by the scope of the following claims.

What is claimed:

1. A table structure, comprising:

an upper portion comprising a planar top surface, a lower plastic portion having a first surface portion for engaging the upper portion and a plurality of downwardly-extending recessed portions;

a reinforcing core interposed between said upper and lower portions; and a folding leg assembly including at least one table-engaging portion shaped for rotational engagement, and extending transversely across the lower plastic portion and at least one leg-receiving surface formed in the plurality of downwardly-extending recessed portions of the lower plastic table portion and shaped for rotatably receiving said at least one transversely extending table-engaging portion of said folding leg assembly.

2. The table structure of claim 1 wherein a plurality of leg-receiving surfaces are formed in the plurality of downwardly-extending recessed portions of the lower plastic table portion for rotatably receiving said at least one table-engaging portion of the folding leg assembly.

3. The table structure of claim 2 wherein said plurality of leg-receiving surfaces comprises a pair of saddles formed by the plurality of downwardly-extending recessed portions in the lower plastic portion adjacent opposing sides of the planar top surface, and the table-engaging portion of the folding leg assembly comprises a tubular portion rotatably received in and extending between said pair of saddles.

4. The table structure of claim 3 wherein said tubular portion is rotatably retained in each of said pair of saddles by each of a pair of retaining straps spanning each saddle.

5. The table structure of claim 4 wherein said plurality of downwardly-extending recessed portions form a peripheral flange; said reinforcing core comprises a pair of wooden beam members received in said peripheral flange; said pair of saddles are formed by said downwardly-extending recessed portions adjacent opposing sides of said peripheral flange; a pair of load-transferring metal brackets engage each of the pair of wooden beam members at locations adjacent said pair of saddles and between said upper and lower table portions; and each of said pair of straps is fastened to said lower plastic table portion, one of said load-transferring metal brackets and one of said wooden beam members by a fastener.

6. The table structure of claim 2 wherein said at least one table-engaging portion comprises a tubular portion that engages and supports said first surface portion of said lower plastic table portion and said planar top surface.

7. The table structure of claim 6 wherein said reinforcing core comprises at least one reinforcing cross member received in at least one of the plurality of downwardly-extending recessed portions at a location spaced from the tubular table-engaging and supporting portion of the folding leg assembly.

8. The table structure of claim 1 wherein said folding leg assembly includes a second table-engaging portion, and said plurality of downwardly-extending recessed portions forms an additional leg-receiving surface for retaining therein said second table-engaging portion of said folding leg assembly.

9. The table structure of claim 8 wherein said second table-engaging portion comprises a second tubular portion of the folding leg assembly which, in engagement with said additional leg-receiving surface, engages and supports said first surface portion of said lower plastic table portion and said planar top surface between its opposing sides at a location spaced from said first table-engaging portion of said folding leg assembly.

10. The table structure of claim 8 wherein said second table-engaging portion of said folding leg assembly is rotatably engaged by and fastened within said additional leg-receiving surface of said lower plastic table portion.

11. The table structure of claim 1 wherein said plurality of downwardly-extending recessed portions form a plurality of leg-receiving surfaces for receiving the folding leg assembly within the lower plastic portion when folded.

12. The table structure of claim 1 wherein said reinforcing core includes portions received in said plurality of downwardly-extending recessed portions.

13. A plastic table, comprising:

a top having a substantially flat rectangular body;

a rectangular plastic base affixed to said top;

a central wooden frame interposed between and enclosed by said top and plastic base, said top, plastic base and wooden frame forming a table top when assembled;

a pair of leg assemblies for supporting said table top above a floor surface, each leg assembly being pivotable between a retracted storage position and an extended operative position, said leg assemblies being longitudinally spaced and positioned to provide stable support of said table top; and means for securing said leg assemblies to said rectangular plastic base of said table top;

said plastic base comprising a plurality of stiffening ribs and deep and shallow recesses integrally formed therein in relief fashion, said recesses being adapted, in part, to receive and partially enclose said central wooden frame in position to support said top; and one or more leg-carrying channels integrally formed by the recesses in the underside of said plastic base for receiving therein said leg assemblies, each leg-carrying channel having a semi-circular bottom and an open top; and bracket means for rotatably securing said pair of leg assemblies to said plastic base and table top.

14. The plastic table as in claim 13 wherein each of said pair of leg assemblies includes a transversely extending member for interfacing the leg-carrying channels formed in the lower plastic table portion for retention therein and for support of the table top across a pair of spaced locations.

15. The plastic table as in claim 14 wherein said central frame includes:

a first side rail extending longitudinally of said table adjacent one long edge thereof and a second side rail also extending longitudinally of said table parallel to said first side rail adjacent the opposing long edge of said table, each said side rail being disposed on its edge with respect to vertical in a deep recess integrally formed in relief fashion in the plastic base of said table top;

a pair of end cross members extending transversely between and affixed to said side rails proximal to the opposing ends of said side rails, each said end cross member being disposed flat with respect to horizontal in a shallow recess integrally formed in relief fashion in the plastic base of said table top;

at least one intermediate cross member extending transversely between and affixed to said side rails, said at least one intermediate cross member being disposed flat with respect to horizontal in a shallow recess integrally formed in relief fashion in the base of said table, said at least one intermediate cross member being disposed between said pair of spaced locations at which the table top is supported by said leg assemblies.

16. The table structure as in claim 15 wherein said table is from five to seven feet length and includes at least one intermediate cross member disposed proximal to the longitudinal center of said table.

17. The table structure as in claim 16 wherein said table is at least eight feet in length and includes first and second intermediate cross members disposed equi-distantly on opposite sides of the longitudinal center of said table.

* * * * *

UNITED STATES PATENT AND TRADEMARK OFFICE

CERTIFICATE OF CORRECTION

PATENT NO. : 5,623,882

DATED : April 29, 1997

INVENTOR(S) : Mark E. Price

It is certified that error appears in the above-indentified patent and that said Letters Patent is hereby corrected as shown below:

In Col. 1, line 59, after "tops", delete "."

In Col. 2, line 12, after "with" insert --a--; after "reinforcing", delete "a".

In Col. 2, line 37, after "through", insert --the--.

In Col. 2, line 65, delete "ther-ebetween" and insert therefor --therebetween--.

In Col. 4, line 39, after "plan view of", delete "a".

In Col. 5, line 19, delete "referenced" and insert therefor --reference--.

In Col. 5, line 21, delete "referenced" and insert therefor --reference--.

In Col. 5, line 24, delete "referenced" and insert therefor --reference--.

In Col. 5, line 27, delete "referenced" and insert therefor --reference--.

UNITED STATES PATENT AND TRADEMARK OFFICE

CERTIFICATE OF CORRECTION

PATENT NO. : 5,623,882

DATED : April 29, 1997

INVENTOR(S) : Mark E. Price

It is certified that error appears in the above-indentified patent and that said Letters Patent is hereby corrected as shown below:

In Col. 7, line 21, after "portion", delete ",".

In Col. 8, line 5, delete "then" and insert therefor --than--.

In Col. 8, line 41, after "underside of", delete "plastic".

In Col. 12, line 48, after "feet", insert --in--.

Signed and Sealed this

Twelfth Day of August, 1997

Bruce Lehman

*Attest:*

BRUCE LEHMAN

*Attesting Officer*

*Commissioner of Patents and Trademarks*